US007704060B2

(12) United States Patent
Morimoto et al.

(10) Patent No.: US 7,704,060 B2
(45) Date of Patent: Apr. 27, 2010

(54) COMPRESSOR HAVING MUFFLER OUTLETS ORTHOGONALLY ARRANGED RELATIVE TO THE SUCTION MOUTH

(75) Inventors: Kouki Morimoto, Kusatsu (JP); Masanori Yanagisawa, Kusatsu (JP); Takehiro Kanayama, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 7 days.

(21) Appl. No.: 12/159,311

(22) PCT Filed: Dec. 12, 2006

(86) PCT No.: PCT/JP2006/324742

§ 371 (c)(1),
(2), (4) Date: Jun. 26, 2008

(87) PCT Pub. No.: WO2007/074637

PCT Pub. Date: Jul. 5, 2007

(65) Prior Publication Data

US 2009/0175740 A1 Jul. 9, 2009

(30) Foreign Application Priority Data

Dec. 28, 2005 (JP) ..... 2005-377122

(51) Int. Cl.
*F03C 2/00* (2006.01)
*F04C 11/00* (2006.01)

(52) U.S. Cl. ..... 418/11; 418/60; 418/181; 418/270

(58) Field of Classification Search ..... 418/11, 418/15, 60, 63, 270, 181, DIG. 1
See application file for complete search history.

(56) References Cited

FOREIGN PATENT DOCUMENTS

| | | | |
|---|---|---|---|
| JP | 55-17914 | U | 2/1980 |
| JP | 02-196189 | A | 8/1990 |
| JP | 03-87886 | U | 9/1991 |
| JP | 05-133377 | A | 5/1993 |
| JP | 2004-27853 | A | 1/2004 |

*Primary Examiner*—Theresa Trieu
(74) *Attorney, Agent, or Firm*—Global IP Counselors

(57) ABSTRACT

A muffler cover of a compression element has discharge outlets or hole portions that discharge a compressed refrigerant gas into a closed vessel from a compression element. A suction pipe provides refrigerant gas, which can be sucked into the compression element in the closed vessel. The suction pipe is attached to the closed vessel. A first direction and a second direction, which correspond to natural vibration modes of the suction pipe, do not coincide with a direction that connects two hole portions. Therefore, even if the refrigerant gas discharged from the compression element resonates in the closed vessel, vibrations of the suction pipe can be reduced.

5 Claims, 5 Drawing Sheets

COMPRESSOR HAVING MUFFLER OUTLETS ORTHOGONALLY ARRANGED RELATIVE TO THE SUCTION MOUTH

CROSS-REFERENCE TO RELATED APPLICATIONS

This U.S. National stage application claims priority under 35 U.S.C.§119(a) to Japanese Patent Application No. 2005-377122, filed in Japan on Dec. 28, 2005, the entire contents of which are hereby incorporated herein by reference.

TECHNICAL FIELD

The present invention relates to a compressor for use in, for example, air conditioners, refrigerators and the like.

BACKGROUND ART

Conventionally, there has been provided a compressor having a closed vessel, a compression element placed in the closed vessel, and a motor that is placed in the closed vessel and drives the compression element via a shaft. The compression element has had a cylinder chamber for compressing a refrigerant gas and a muffler chamber for reducing the pulsation of the refrigerant gas discharged from the cylinder chamber, and the muffler chamber has had two outlets for discharging the refrigerant gas into the closed vessel (refer to JP 5-133377 A).

However, according to the conventional compressor, in a case where a suction pipe to which an accumulator is connected is attached to the suction mouth of the closed vessel, if a direction that connects arbitrary two of all the outlets coincide with a first direction that is a central axis direction of a portion located in the vicinity of the suction mouth of the suction pipe or a second direction perpendicular to the first direction in an orthogonal projection to a plane that is perpendicular to the central axis of the closed vessel and passes through the center of the portion located in the vicinity of the suction mouth of the suction pipe, then the refrigerant gas discharged from the outlets resonates in the closed vessel, and vibrations due to the resonance propagates to the closed vessel, consequently causing significant vibrations of the suction pipe and the accumulator. There has been the problem of the vibrations of the suction pipe only with the suction pipe without the accumulator.

This is because the direction that connects the two outlets is the direction in which the pressure amplitude in the resonant mode of the discharged refrigerant gas is great, and the first direction and the second direction are the directions in which the oscillation amplitude in the natural vibration mode of the suction pipe is great, and the directions of the resonant mode and the natural vibration mode mutually coincide.

SUMMARY OF THE INVENTION

It is an object of the present invention to provide a compressor capable of reducing the vibrations of the suction pipe and the accumulator even if the refrigerant gas discharged from the compression element resonates in the closed vessel.

In order to solve the above problem, the compressor of the present invention comprises:

a closed vessel;

a compression element placed in the closed vessel; and a motor which is placed in the closed vessel and drives the compression element via a shaft, wherein a suction pipe that sucks a refrigerant gas is attached to a suction mouth of the closed vessel, the compression element comprises at least one cylinder chamber that compresses the refrigerant gas and a muffler chamber that reduces pulsation of the refrigerant gas discharged from the cylinder chamber, the muffler chamber has at least one suction mouth that sucks the refrigerant gas and a plurality of outlets that discharge the refrigerant gas into the closed vessel, and in an orthogonal projection to a plane that is perpendicular to a central axis of the closed vessel and passes through a center of a portion of the suction pipe located in the vicinity of the suction mouth, a direction that connects arbitrary two of all the outlets coincides with neither a first direction that is a central axis direction of the portion of the suction pipe located in the vicinity of the suction mouth nor a second direction perpendicular to the first direction.

According to the compressor of the present invention, the first direction and the second direction do not coincide with the direction that connects the two outlets, and therefore, the direction that connects the two outlets is shifted with respect to the first direction and the second direction that are the directions of the natural vibration mode of the suction pipe.

Therefore, even if the refrigerant gas discharged from the outlets resonates in the closed vessel and vibrations due to the resonance propagates to the closed vessel, the direction of the resonant mode (i.e., the direction that connects the two outlets) is shifted with respect to the directions of the natural vibration mode (i.e., the first direction and the second direction) of the suction pipe, the vibrations of the suction pipe can be reduced.

In accordance with one aspect of the present invention, gas channels from each suction mouth to all the outlets have generally mutually equal acoustic characteristics.

In accordance with this aspect, the fact that the acoustic characteristics of the gas channels are mutually equal has the meaning that the magnitudes and phases of the pulsations of the refrigerant gas that has passed through the gas channels mutually coincide, or, for example, the meaning that the lengths and the cross-sectional shapes of the gas channels are mutually equal.

In a compressor in accordance with this aspect, all the gas channels have generally mutually equal acoustic characteristics. Therefore, the refrigerant gas discharged from the outlets through the gas channels can mutually cancel the pulsations thereof in the closed vessel, and the resonance of the refrigerant gas can be further suppressed.

In accordance with another aspect of the present invention, an accumulator is connected to the suction pipe.

In a compressor in accordance with this aspect, the vibrations of the suction pipe can be reduced even if the closed vessel vibrates due to the resonance of the refrigerant gas, and therefore, the vibrations of the accumulator can be reduced.

In accordance with another aspect of the present invention, the compression element comprises:

a cylinder;

an end plate member which is attached to an open end of the cylinder and forms the cylinder chamber with the cylinder;

a first muffler cover which is attached to the end plate member oppositely from the cylinder and forms a space that communicates with the cylinder chamber with the end plate member; and a second muffler cover which is attached to the outside of the first muffler cover and forms the muffler chamber that communicates with the space with the first muffler cover.

In a compressor in accordance with this aspect, the compression element is the so-called double-deck muffler that has the first muffler cover and the second muffler cover, and therefore, the pulsation of the refrigerant gas can be further reduced.

In accordance with another aspect of the present invention, the first muffler cover has an engagement portion that is one of a projection and a hole on a surface facing the second muffler cover, the second muffler cover has an engagement portion that is the other of the projection and the hole on a surface facing the first muffler cover, and the engagement portion of the first muffler cover and the engagement portion of the second muffler cover are mutually releasably engaged.

In a compressor in accordance with this aspect, the engagement portion of the first muffler cover and the engagement portion of the second muffler cover are mutually releasably engaged, and therefore, the first muffler cover and the second muffler cover can be assembled without relative misalignment.

In accordance with another aspect of the present invention, the refrigerant gas is carbon dioxide.

In a compressor in accordance with this aspect, carbon dioxide is used for the refrigerant gas. In this case, the vibrations due to the resonance are increased since carbon dioxide has a large refrigerating capacity per unit volume, high refrigerant gas pressure and increased pulsation of the refrigerant gas. Therefore, it is effective to provide a construction in which the first direction and the second direction of the natural vibration mode of the suction pipe do not coincide with the direction that connects the two hole portions particularly for the reduction in the vibrations of the suction pipe of the compressor that employs a refrigerant of a great refrigerating capacity.

According to the compressor of the present invention, the first direction and the second direction do not coincide with the direction that connects the two outlets. Therefore, even if the refrigerant gas discharged from the compression element resonates in the closed vessel, the vibrations of the suction pipe can be reduced.

DETAILED DESCRIPTION OF THE INVENTION

Figure 1:
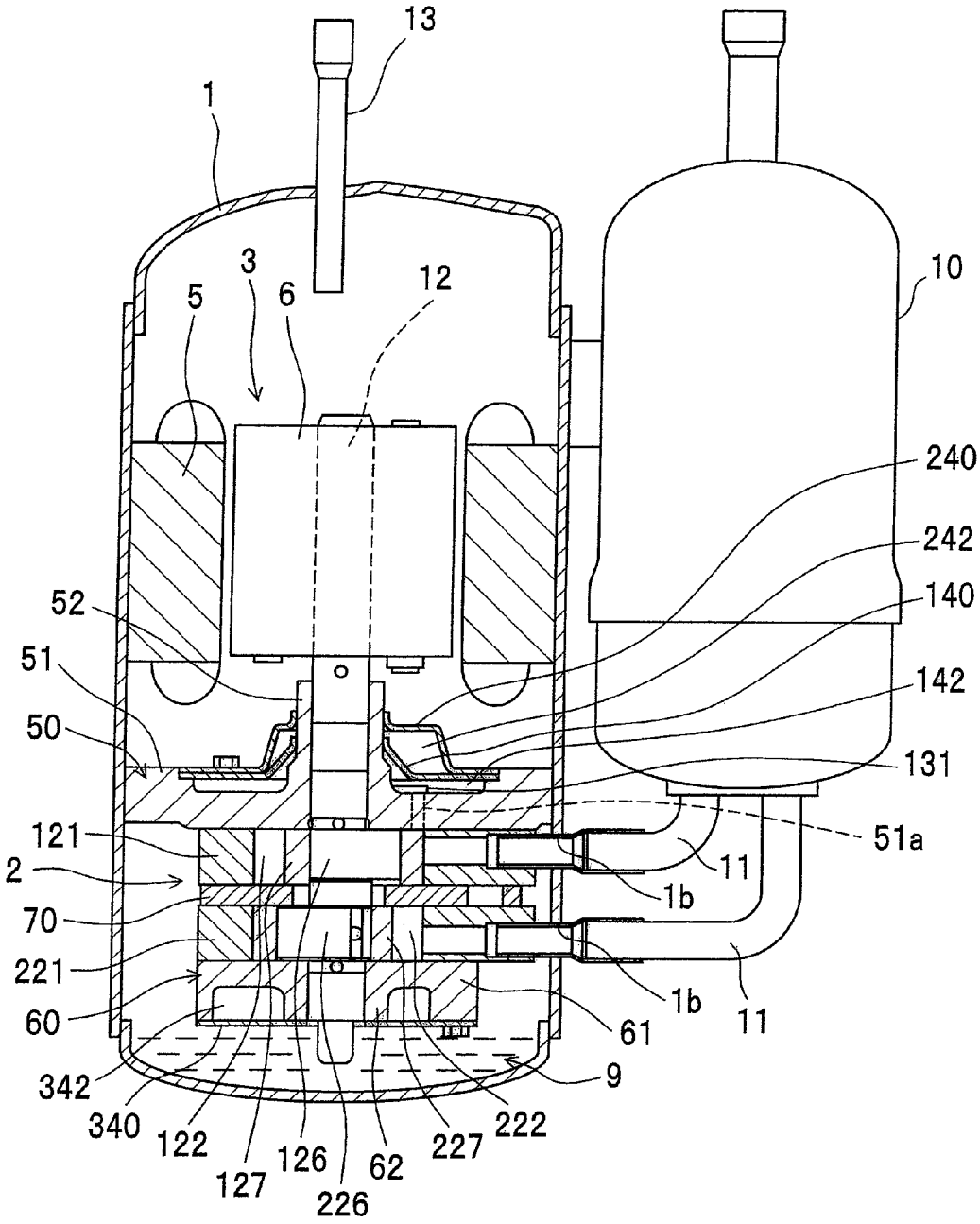
FIG. 1 is a longitudinal sectional view showing a first embodiment of the compressor of the present invention.

The present invention will now be described in detail below by the embodiments shown in the drawings.

First Embodiment

FIG. 1 shows a longitudinal sectional view of the first embodiment of the compressor of the present invention. The compressor has a closed vessel 1, a compression element 2 placed in the closed vessel 1, and a motor 3 that is placed in the closed vessel 1 and drives the compression element 2 via a shaft 12. The compressor is the so-called high-pressure dome type rotary compressor, where the compression element 2 is placed in a lower portion and the motor 3 is placed in an upper portion in the closed vessel 1.

A suction pipe 11 that sucks a refrigerant gas is attached to the closed vessel 1, and an accumulator 10 is connected to the suction pipe 11. That is, the compression element 2 sucks the refrigerant gas from the accumulator 10 through the suction pipe 11.

The refrigerant gas is obtained by controlling a condenser, an expansion mechanism and an evaporator (not shown) that constitute an air conditioner as one example of the refrigeration system with the compressor. The refrigerant gas is, for example, carbon dioxide, R410A or R22.

The compressor fills the inside of the closed vessel 1 with a compressed high-temperature high-pressure discharge gas discharged from the compression element 2 and discharges the gas to the outside from a delivery pipe 13 after cooling the motor 3. A lubricating oil 9 is collected in a lower portion of a high-pressure region in the closed vessel 1.

The motor 3 has a rotor 6 and a stator 5 placed radially outside the rotor 6 via an airgap. The shaft 12 is attached to the rotor 6.

The rotor 6 has a rotor main body constructed of, for example, laminated magnetic steel sheets, and magnets embedded in the rotor main body. The stator 5 has a stator main body made of, for example, iron and coils wound around the stator main body.

The motor 3 rotates the rotor 6 with the shaft 12 by electromagnetic forces generated at the stator 5 by flowing a current through the coils and drives the compression element 2 via the shaft 12.

The compression element 2 has an upper end plate member 50, a first cylinder 121, an intermediate end plate member 70, a second cylinder 221 and a lower end plate member 60 in order from top to bottom along the rotational axis of the shaft 12.

The upper end plate member 50 and the intermediate end plate member 70 are attached to upper and lower opening ends, respectively, of the first cylinder 121. The intermediate end plate member 70 and the lower end plate member 60 are attached to upper and lower opening ends, respectively, of the second cylinder 221.

A first cylinder chamber 122 is formed of the first cylinder 121, the upper end plate member 50 and the intermediate end plate member 70. A second cylinder chamber 222 is formed of the second cylinder 221, the lower end plate member 60 and the intermediate end plate member 70.

Figure 2:
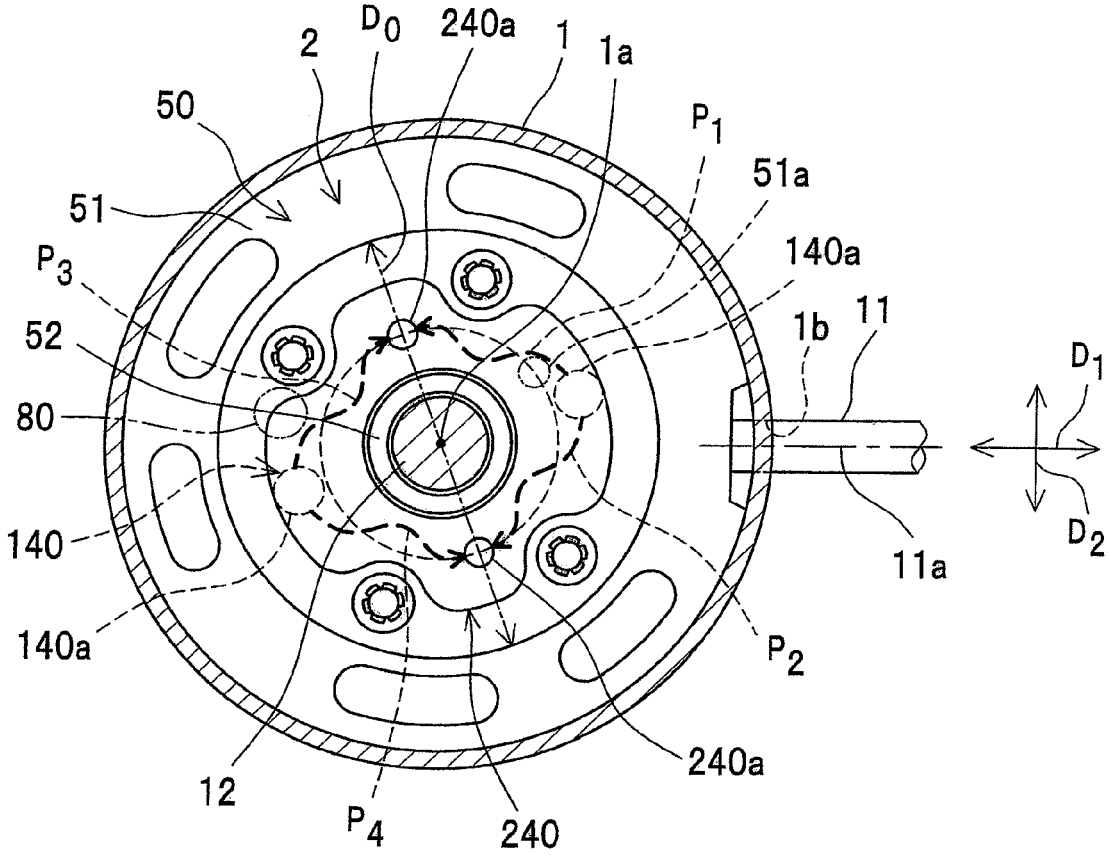
FIG. 2 is a transverse sectional view of the compressor viewed from the upper surface of a compression element.

As shown in FIGS. 1 and 2, the upper end plate member 50 has a disk-shaped main body portion 51 and a boss portion 52 provided extending upward at the center of the main body portion 51. The main body portion 51 and the boss portion 52 receive the shaft 12 inserted therethrough. A delivery port 51*a* that communicates with the first cylinder chamber 122 is provided at the main body portion 51.

A delivery valve 131 is attached to the main body portion 51 so as to be positioned oppositely from the first cylinder 121 with respect to the main body portion 51. The delivery valve 131 is, for example, a reed valve to open and close the delivery port 51*a*.

A cup-shaped first muffler cover 140 is attached to the main body portion 51 oppositely from the first cylinder 121 so as to cover the delivery valve 131. The first muffler cover 140 is fixed to the main body portion 51 with a fixing member (bolt or the like). The first muffler cover 140 receives the boss portion 52 inserted therethrough.

A first muffler chamber 142 is formed as a space of the first muffler cover 140 and the upper end plate member 50. The first muffler chamber 142 and the first cylinder chamber 122 communicate with each other via the delivery port 51*a*.

A cup-shaped second muffler cover 240 is attached to the first muffler cover 140 oppositely from the upper end plate member 50. A second muffler chamber 242 is formed of the first muffler cover 140 and the second muffler cover 240.

The first muffler chamber 142 and the second muffler chamber 242 communicate with each other through hole portions 140*a* interposedly formed therebetween at the first muffler cover 140. The second muffler chamber 242 and the outside of the second muffler cover 240 communicate with each other through hole portions 240*a* formed at the second muffler cover 240.

That is, the second muffler chamber 242 has two hole portions 140*a* as inlets to suck the refrigerant gas and two hole portions 240*a* as outlets to discharge the refrigerant gas into the closed vessel 1.

The two hole portions 140*a* are positioned 180° oppositely from each other with respect to the rotational axis of the shaft 12. The two hole portions 240*a* are positioned 180° oppositely from each other with respect to the rotational axis of the shaft 12. A direction that connects the two hole portions 140*a* is perpendicular to a direction that connects the two hole portions 240*a*. The rotational axis of the shaft 12 coincides with a central axis 1*a* of the closed vessel 1.

In an orthogonal projection to a plane that is perpendicular to the central axis 1*a* of the closed vessel 1 and passes through the center of a portion of the suction pipe 11 located in the vicinity of a suction mouth 1*b* for the suction pipe 11, a direction $D_0$ that connects the two hole portions 240*a* coincides with neither a first direction $D_1$ that is the direction of the central axis 11*a* of the portion of the suction pipe 11 located in the vicinity of the suction mouth 1*b* nor a second direction $D_2$ perpendicular to the first direction $D_1$.

The first direction $D_1$ and the second direction $D_2$ are the directions of the natural vibration mode of the suction pipe 11. That is, the direction $D_0$ that connects the two hole portions 240*a* is shifted with respect to the directions of the natural vibration mode of the suction pipe 11.

A first gas channel $P_1$ from one hole portion (inlet) 140*a* to one hole portion (outlet) 240*a* in the second muffler chamber 242 and a second gas channel $P_2$ from the one hole portion (inlet) 140*a* to the other hole portion (outlet) 240*a* in the second muffler chamber 242 have generally mutually equal acoustic characteristics.

In this case, the fact that the acoustic characteristics of the two gas channels $P_1$ and $P_2$ are mutually equal has the meaning that the magnitudes and phases of the pulsations of the refrigerant gas that has passed through the two gas channels $P_1$ and $P_2$ mutually coincide, or, for example, the meaning that the lengths and the cross-sectional shapes of the two gas channels $P_1$ and $P_2$ are mutually equal. That is, the shapes of the two gas channels $P_1$ and $P_2$ are laterally symmetrical with respect to a line segment that connects the two hole portions (outlets) 240*a*.

A third gas channel $P_3$ from the other hole portion (inlet) 140*a* to the one hole portion (outlet) 240*a* in the second muffler chamber 242 and a fourth gas channel $P_4$ from the other hole portion (inlet) 140*a* to the other hole portion (outlet) 240*a* in the second muffler chamber 242 have generally mutually equal acoustic characteristics.

By providing restrictions at the second muffler cover 240, all the gas channels $P_1$, $P_2$, $P_3$ and $P_4$ are formed in a meandering shape. All the gas channels $P_1$, $P_2$, $P_3$ and $P_4$ have generally mutually equal acoustic characteristics.

Figure 3:
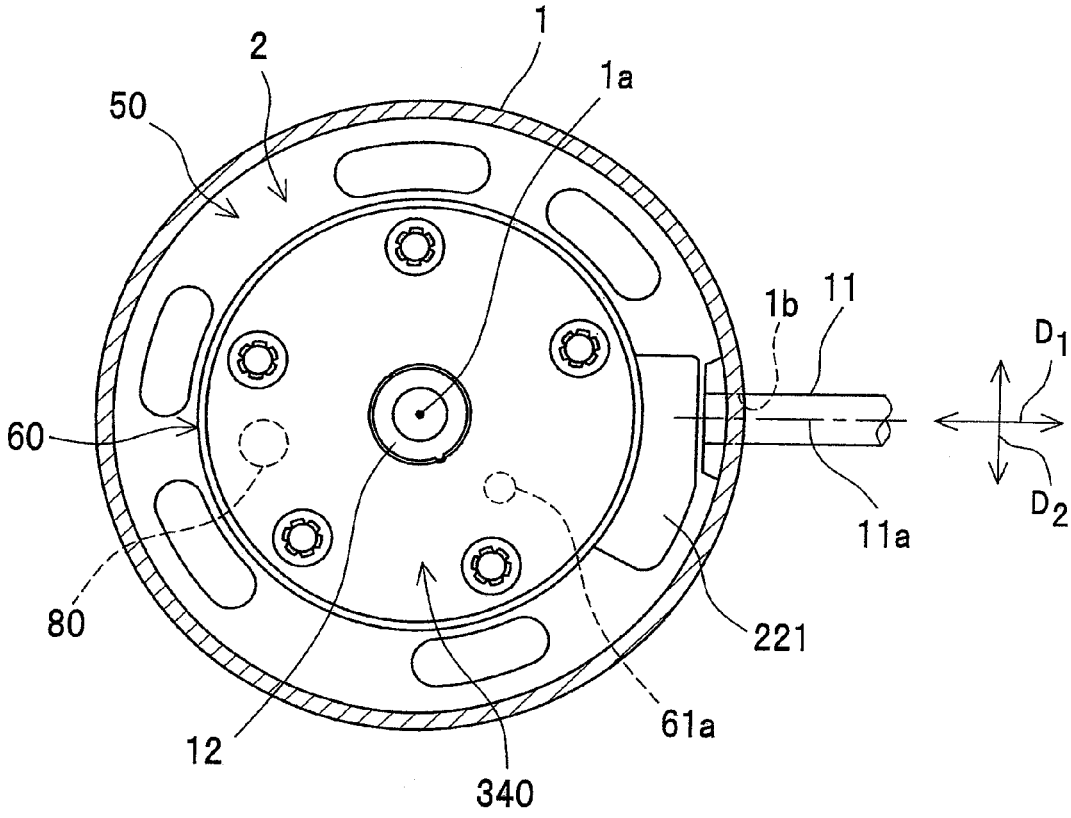
FIG. 3 is a transverse sectional view of the compressor viewed from the lower surface of the compression element.

As shown in FIGS. 1 and 3, the lower end plate member 60 has a disk-shaped main body portion 61 and a boss portion 62 that is provided extending downward at the center of the main body portion 61. The main body portion 61 and the boss portion 62 receive the shaft 12 inserted therethrough. A delivery port 61*a* that communicates with the second cylinder chamber 222 is provided at the main body portion 61.

A delivery valve (not shown) is attached to the main body portion 61 so as to be positioned oppositely from the second cylinder 221 with respect to the main body portion 61, and the delivery valve opens and closes the delivery port 61*a*.

A planar flat plate-shaped third muffler cover 340 is attached to the main body portion 61 so as to cover the delivery valve oppositely from the second cylinder 221. The third muffler cover 340 is fixed to the main body portion 61 with a fixing member (bolt or the like). The third muffler cover 340 receives the boss portion 62 inserted therethrough.

A third muffler chamber 342 is formed of the third muffler cover 340 and the lower end plate member 60. The third muffler chamber 342 and the second cylinder chamber 222 communicate with each other via the delivery port 61*a*.

As shown in FIGS. 2 and 3, the second muffler chamber 242 and the third muffler chamber 342 communicate with each other through a hole portion 80, which is formed in the lower end plate member 60, the second cylinder 221, the intermediate end plate member 70, the first cylinder 121 and the upper end plate member 50.

The end plate members 50, 60, 70, the cylinders 121, 221, and the muffler covers 140, 240, 340 are integrally fixed with a fixing member of bolts or the like. The upper end plate member 50 of the compression element 2 is attached to the closed vessel 1 by welding or the like.

One end portion of the shaft 12 is supported by the upper end plate member 50 and the lower end plate member 60. That is, the shaft 12 is cantilevered. One end portion (supported end side) of the shaft 12 enters inside the first cylinder chamber 122 and the second cylinder chamber 222.

A first eccentric pin 126 is provided for the shaft 12 so as to be placed in the first cylinder chamber 122. The first eccentric pin 126 is fitted in a first roller 127. The first roller 127 is revolvably arranged in the first cylinder chamber 122, and compression operation is performed by the revolving motions of the first roller 127.

A second eccentric pin 226 is provided for the shaft 12 so as to be placed in the second cylinder chamber 222. The second eccentric pin 226 is fitted in a second roller 227. The second roller 227 is revolvably arranged in the second cylinder chamber 222, and compression operation is performed by the revolving motions of the second roller 227.

The first eccentric pin 126 and the second eccentric pin 226 are positioned mutually shifted by 180° with respect to the rotational axis of the shaft 12.

The compression operation of the first cylinder chamber 122 is described next.

Figure 4:
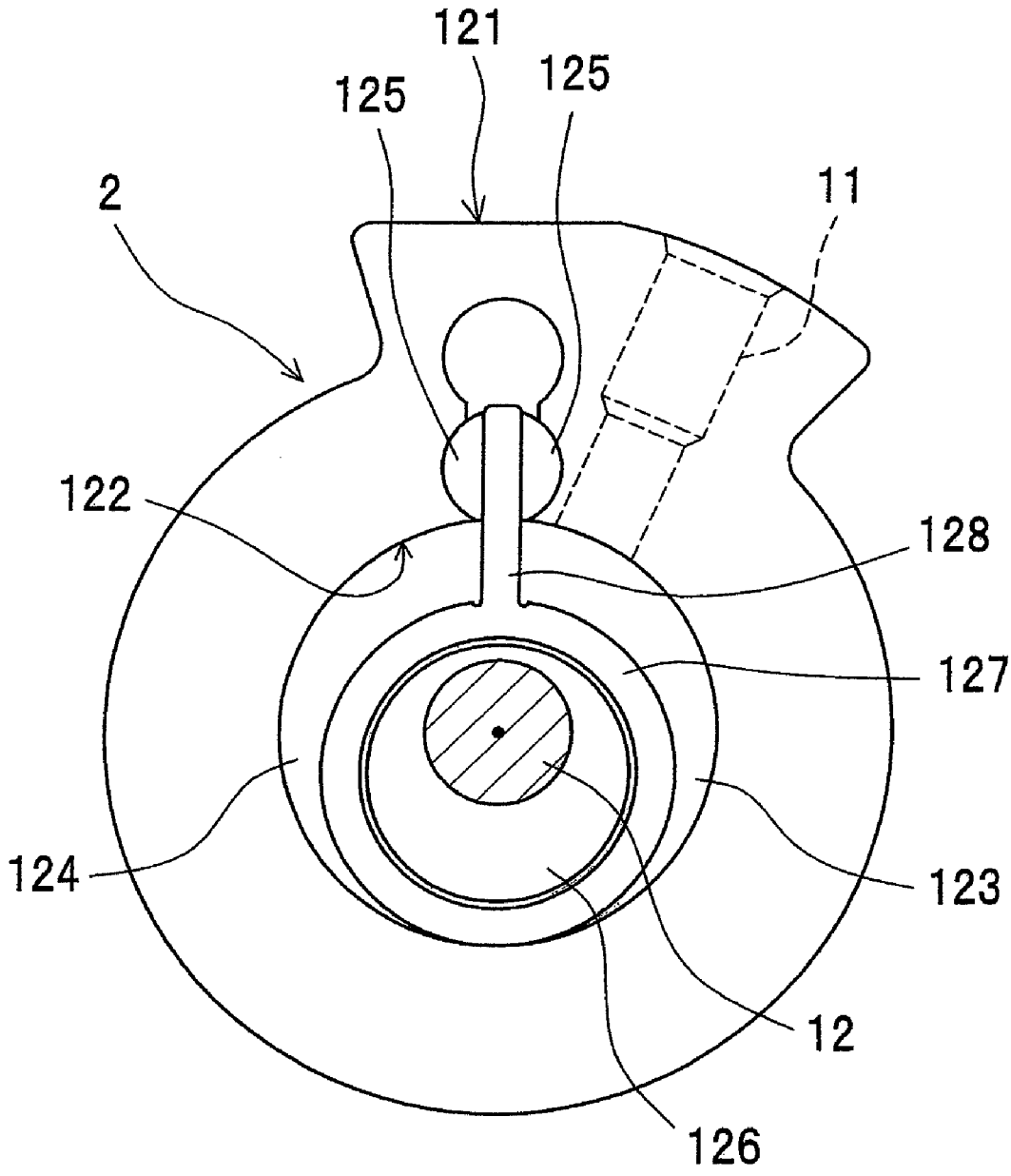
FIG. 4 is a plan view of an essential part of the compressor.

As shown in FIG. 4, the first cylinder chamber 122 is internally partitioned by a blade 128 integrally provided with the roller 127. That is, in a chamber located on the right-hand side of the blade 128, one suction pipe 11 opens at the inner surface of the first cylinder chamber 122 and forms a suction chamber (low-pressure chamber) 123. On the other hand, in a chamber located on the left-hand side of the blade 128, the delivery port 51*a* (shown in FIG. 1) opens at the inner surface of the first cylinder chamber 122 and forms a delivery chamber (high-pressure chamber) 124.

Semicylindrical bushing 125, 125 are brought in tight contact with both surfaces of the blade 128 and effect sealing. Lubrication is achieved by the lubricating oil 9 between the blade 128 and the bushing 125, 125.

Then, the first eccentric pin 126 eccentricity rotates with the shaft 12, and the first roller 127 fitted on the first eccentric pin 126 revolves with the outer peripheral surface of the first roller 127 brought in contact with the inner peripheral surface of the first cylinder chamber 122.

In accordance with the revolution of the first roller 127 in the first cylinder chamber 122, the blade 128 advances and retreats with both side surfaces of the blade 128 being held by the bushing 125, 125. Then, a low-pressure refrigerant gas is sucked from the suction pipe 11 into the suction chamber 123 and compressed to a high pressure in the delivery chamber 124, and thereafter, a high-pressure refrigerant gas is discharged from the delivery port 51*a* (shown in FIG. 1).

Subsequently, as shown in FIGS. 1 and 2, the refrigerant gas discharged from the delivery port 51*a* to the first muffler chamber 142 enters the second muffler chamber 242 from the two hole portions 140*a* of the first muffler cover 140.

Then, the refrigerant gas sucked from the one hole portion (inlet) 140*a* is discharged from the one hole portion (outlet) 240*a* to the outside (inside the closed vessel 1) of the second muffler cover 240 through the first gas channel $P_1$ and discharged from the other hole portion (outlet) 240*a* into the closed vessel 1 through the second gas channel $P_2$.

At the same time, the refrigerant gas sucked from the other hole portion (inlet) 140*a* is discharged from the one hole portion (outlet) 240*a* to the outside (inside the closed vessel 1) of the second muffler cover 240 through the third gas channel $P_3$ and discharged from the other hole portion (outlet) 240*a* into the closed vessel 1 through the fourth gas channel $P_4$.

On the other hand, the compression operation of the second cylinder chamber 222 is also similar to the compression operation of the first cylinder chamber 122. That is, as shown in FIGS. 1 and 3, a low-pressure refrigerant gas is sucked from the other suction pipe 11 into the second cylinder chamber 222, and the refrigerant gas is compressed by the revolving motions of the second roller 227 in the second cylinder chamber 222. The high-pressure refrigerant gas is discharged from the delivery port 61*a* to the third muffler chamber 342.

The refrigerant gas in the third muffler chamber 342 enters the first muffler chamber 142 through the hole portion 80. Subsequently, the refrigerant gas is discharged to the outside of the second muffler cover 240 via the second muffler chamber 242 as described above.

The compression operation of the first cylinder chamber 122 and the compression operation of the second cylinder chamber 222 have phases mutually shifted by 180°.

According to the compressor of the above construction, the first direction $D_1$ and the second direction $D_2$ do not coincide with the direction $D_0$ that connects the two hole portions (outlets) 240*a*. Therefore, the direction $D_0$ that connects the two hole portions 240*a* is shifted with respect to the first direction $D_1$ and the second direction $D_2$ that are the directions of the natural vibration mode of the suction pipe 11.

Therefore, even if the refrigerant gas discharged from the two hole portions 240*a* resonates in the closed vessel 1 and vibrations due to the resonance propagates to the closed vessel 1, the vibrations of the suction pipe 11 and the accumulator 10 can be reduced since the direction of the resonant mode (i.e., the direction $D_0$ that connects the two hole portions 240*a*) and the direction of the natural vibration mode (i.e., the first direction $D_1$ and the second direction $D_2$) of the suction pipe 11 are mutually shifted.

It is noted that an angle between the direction $D_0$ that connects the two hole portions 240*a* and the first direction $D_1$ should preferably be 30° to 60° and more preferably be about 45°, when the vibrations of the suction pipe 11 and the accumulator 10 can be further reduced.

Moreover, since all the gas channels $P_1$, $P_2$, $P_3$, $P_4$ have generally mutually equal acoustic characteristics, the refrigerant gas discharged from the hole portions (outlets) 240*a* through the gas channels $P_1$, $P_2$, $P_3$, $P_4$ can mutually cancel the pulsations in the closed vessel 1, and the resonance of the refrigerant gas can be further suppressed.

Moreover, since the compression element 2 is the so-called double-deck muffler that has the first muffler cover 140 and the second muffler cover 240, the pulsation of the refrigerant gas can be further reduced.

Moreover, since the pressure of the refrigerant gas is high and the pulsation of the refrigerant gas is increased in the compressor that uses a refrigerant of a great refrigerating capacity such as carbon dioxide, the vibrations due to the resonance are also increased. Therefore, it is effective to provide the construction in which the first direction $D_1$ and the second direction $D_2$ of the natural vibration mode of the suction pipe 11 do not coincide with the direction $D_0$ that connects the two hole portions 240*a* particularly for the reduction in the vibrations of the suction pipe 11 of the compressor that employs the refrigerant of a great refrigerating capacity.

Second Embodiment

Figure 5:
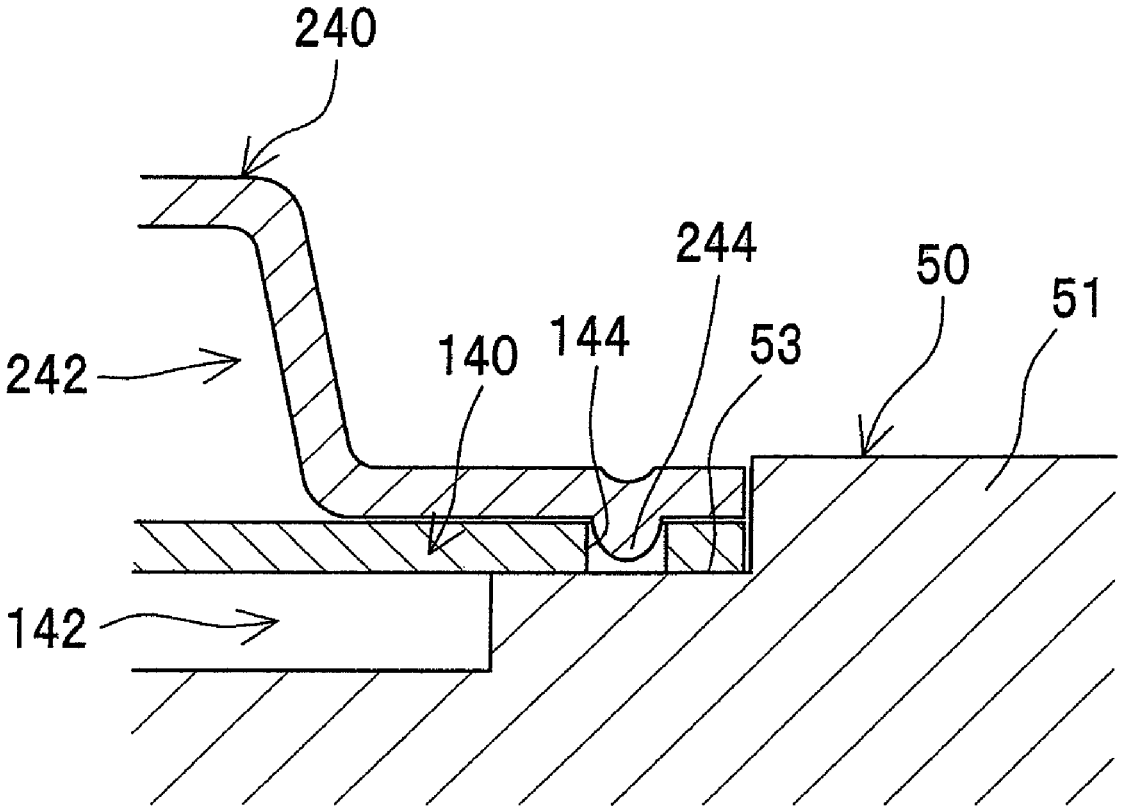
FIG. 5 is a longitudinal sectional view of an essential part showing a second embodiment of the compressor of the present invention.

FIG. 5 shows a second embodiment of the compressor of the present invention. If a point of difference from the first embodiment is described, the constructions of the first muffler cover 140 and the second muffler cover 240 differ in the second embodiment.

The first muffler cover 140 has an engagement portion 144 that is a hole at its surface facing the second muffler cover 240. The second muffler cover 240 has an engagement portion 244 that is a projection on its surface facing the first muffler cover 140. The engagement portion 144 of the first muffler cover 140 and the engagement portion 244 of the second muffler cover 240 are mutually releasably engaged.

It is acceptable that the engagement portion 144 of the first muffler cover 140 is a projection and the engagement portion 244 of the second muffler cover 240 is a hole.

Therefore, the first muffler cover 140 and the second muffler cover 240 can be assembled without relative misalignment. That is, the engagement portion 144 of the first muffler cover 140 and the engagement portion 244 of the second muffler cover 240 are to avoid blunders.

The upper end plate member 50 has a recess portion 53 in which the first muffler cover 140 and the second muffler cover 240 are fitted. Therefore, the first muffler cover 140 and the second muffler cover 240 are positioned by the recess portion 53 of the end plate member 50.

The present invention is limited to neither of the above embodiments. For example, a rotary type in which the roller and the blade are separate bodies is acceptable as the compression element 2. A scroll type or a reciprocating type may be employed besides the rotary type as the compression element 2. A one-cylinder type that has one cylinder chamber is also acceptable as the compression element 2. A single-deck muffler is also acceptable by removing the second muffler cover 240.

There may be at least one hole portion (inlet) 140*a* to the second muffler chamber 242 and at least three hole portions (outlets) 240*a* from the second muffler chamber 242.

Moreover, it is acceptable to directly connect a structural component of an outdoor unit to the suction pipe 11 without providing the accumulator 10.

What is claimed is:

1. A compressor comprising:

a closed vessel;

a compression element disposed in the closed vessel, the compression element including a cylinder, an end plate member attached to an open end of the cylinder to form at least one cylinder chamber with the cylinder, a first muffler cover attached to the end plate member on an opposite side from the cylinder to form a space in fluid communication with the cylinder chamber through the end plate member, and a second muffler cover attached to an opposite side of the first muffler cover from the end plate member to form a muffler chamber that is in fluid communication with the space through the first muffler cover; and a motor disposed in the closed vessel to drive the compression element via a shaft, wherein a suction pipe attached to a suction mouth of the closed vessel to provide refrigerant gas, the cylinder chamber being arranged to compress refrigerant gas sucked into the compression chamber from the suction mouth and the muffler chamber being configured to reduce pulsation of compressed refrigerant gas discharged from the cylinder chamber, the muffler chamber having at least one inlet hole portion that receives the compressed refrigerant gas from the compression element into the muffler chamber and a plurality of outlets that discharge the compressed refrigerant gas from the muffler chamber into the closed vessel, and in an orthogonal projection to a plane that is perpendicular to a central axis of the closed vessel and passes through a center of a portion of the suction pipe located in a vicinity of the suction mouth, a direction connecting an arbitrary pair of the outlets coincides with neither a first direction nor a second direction, the first direction being parallel to a central axis of the portion of the suction pipe located in the vicinity of the suction mouth and the second direction being perpendicular to the first direction.

2. The compressor as claimed in claim 1, wherein gas channels from each inlet hole portion to all the outlets have generally mutually equal acoustic characteristics.

3. The compressor as claimed in claim 1, further comprising an accumulator connected to the suction pipe.

4. The compressor as claimed in claim 1, wherein the first muffler cover has an engagement portion on a surface facing the second muffler cover that is one of a projection and a hole, the second muffler cover has an engagement portion on a surface facing the first muffler cover that is the other of the projection and the hole, and the engagement portion of the first muffler cover and the engagement portion of the second muffler cover are releasably engaged with each other.

5. The compressor as claimed in claim 1, wherein the refrigerant gas is carbon dioxide.

* * * * *